US005492436A

United States Patent [19]

Suksumake

[11] Patent Number: 5,492,436

[45] Date of Patent: Feb. 20, 1996

[54] APPARATUS AND METHOD FOR MOVING RIG STRUCTURES

[75] Inventor: S. Karl Suksumake, Metairie, La.

[73] Assignee: Pool Company, Houston, Tex.

[21] Appl. No.: 227,790

[22] Filed: Apr. 14, 1994

[51] Int. Cl.[6] ..... E02B 17/00

[52] U.S. Cl. ..... 405/201; 166/366; 180/7.2; 254/103; 301/5.23; 305/39

[58] Field of Search ..... 405/195.1, 196, 405/201, 224; 166/79, 353, 366; 180/7.1, 7.2; 254/1, 103, 105; 301/5.23; 305/39

[56] References Cited

U.S. PATENT DOCUMENTS

| | | | |
|---|---|---|---|
| 657,129 | 9/1900 | McCollister | 305/39 X |
| 722,433 | 3/1903 | Ritchie | 301/5.23 X |
| 1,232,597 | 7/1917 | Noble | 305/39 X |
| 2,668,517 | 2/1954 | Craft | 166/79 X |
| 3,031,167 | 4/1962 | Roussel | 254/105 |
| 3,033,525 | 5/1962 | Johnson | 405/201 X |
| 3,802,137 | 4/1974 | Armstrong . | |
| 4,288,177 | 9/1981 | Schoonmade | 405/201 X |
| 4,602,894 | 7/1986 | Lorenz et al. | 405/196 X |
| 4,823,870 | 4/1989 | Sorokan | 405/201 X |

FOREIGN PATENT DOCUMENTS

| | | | |
|---|---|---|---|
| 1397354 | 5/1988 | U.S.S.R. | 301/5.23 |

*Primary Examiner*—John A. Ricci
*Attorney, Agent, or Firm*—Crutsinger & Booth

[57] ABSTRACT

Disclosed is an improved apparatus and method of moving a large, heavy structure or piece of machinery, such as an oil rig structure on an offshore platform. A plurality of load bearing plates are provided for supporting the structure. Each of the load bearing plates rides upon a plurality of rollers connected together by an endless chain revolving about a central core member when the structure is to be moved. A motor drives the endless chain connecting the rollers on which at least one of the load bearing plates rides when the structure is to be moved. A worm gear coupled to the motor transmits the motion of the motor to the endless chain to translate the structure across a platform.

15 Claims, 3 Drawing Sheets

APPARATUS AND METHOD FOR MOVING RIG STRUCTURES

TECHNICAL FIELD

The present inventions relate to improvements in apparatuses and methods for moving oil rig structures, primarily on offshore platforms.

BACKGROUND OF THE INVENTIONS

Offshore wells are often drilled from a stationary platform set in the water. Typically, several wells are drilled from the same platform because of the expense of the platforms and drilling operations and to facilitate servicing of completed wells.

Following completion of the wells, it is often necessary to do "workover" operations, such as replacing down-the-hole equipment, acidizing, fracturing, and wash-out operations. These operations are performed with a "workover" rig which is similar to a drilling rig, but usually smaller because it is not required to carry as heavy weights of pipe. "Workover" rigs may also be used for the drilling of relatively shallow wells. After installation on a platform, the workover rig must be moved over each well to service the wells drilled from the platform.

In the past, offshore platform drilling and workover rigs were moved to different locations on the offshore platform by pushing or pulling the rigs along greased metal-to-metal tracks. This method required a large amount of force to overcome the sliding friction between the rigs and the tracks. Subsequently, carriages consisting of "chain rollers," such as those manufactured by Hilman Rollers, 2604 Atlantic Avenue, Wall, N.J. 07719, were tried on rigs. The resistance encountered in moving the rig was reduced from a sliding friction to a rolling friction when these chain rollers were used; however, an external means of power to move the rig was still required. Typically, a block and tackle cable system or a system of hydraulic cylinders and skidding claws were used as the moving mechanism. (One example of hydraulic cylinders being used is disclosed in U.S. Pat. No. 3,802,137 to Armstrong). The block and tackle cable system was disadvantageous because it was tedious and slow, and also because it was impractical where only the upper structure of a rig, such as that disclosed in U.S. Pat. No. 3,802,137 to Armstrong, was to be moved. In the hydraulic cylinders and skidding claws system, the hydraulic cylinders provided the force to move the rig structure while the skidding claws provided an anchoring point. The mechanism had to be anchored before any force could be exerted and the rig structure could only be moved for a distance equal to the stroke length of the cylinders. The cylinders would then be contracted, the skidding claws moved to their next anchoring point, and the process repeated. This process was obviously repetitive, tedious, and slow.

It was therefore an important objective of these new inventions to provide a mechanism that combined a high load-carrying capacity with a means for mobilizing the load carried by the mechanism and that would not require that any external force be applied. It was also an important objective of these new inventions to provide a mechanism that would allow the load to remain stationary once it had been moved to the desired position.

SUMMARY OF THE INVENTIONS

The present inventions provide a method and apparatus for moving a rig structure or other heavy equipment on an offshore platform.

In accordance with a preferred embodiment of these inventions, a self-powered rig moving system is provided with a roller assembly comprising a plurality of load bearing plates for supporting a rig structure on an offshore platform. Each load bearing plate has downwardly extending side plate members and forward and rearward plate members forming a box-like enclosure for capturing a plurality of rollers connected together by an endless chain revolving about a central core member for moving the structure. The central core is fixed between the two downwardly extending side plates.

The roller assemblies are preferably positioned such that the weight of the structure to be moved is uniformly distributed among the roller assemblies, as for example one at each corner of the base of the structure when the entire structure is to be moved.

A driving means drives the endless chain connecting the rollers in at least one of the roller assemblies when the structure is to be moved. The driving means is connected to the roller assembly and may consist of a hydraulic or electric motor. A transmission means, such as a worm gear which meshes with and engages the rollers and endless chain, transmits motion of the motor to the endless chain. The worm gear may be coupled to the motor through suitable gearing.

These and various other advantages and features of novelty which characterize the inventions are pointed out with particularity in the one or more claims annexed hereto and forming a part hereof. However, for a better understanding of the inventions, their advantages, and the objects attained by their use, reference should be made to the detailed description and drawings which form a further part hereof, in which there is described and illustrated preferred embodiments of the inventions.

BRIEF DESCRIPTION OF THE DRAWINGS

The accompanying drawings are incorporated into and form a part of the specification to illustrate several examples of the present inventions. These drawings together with a description serve to explain the principles of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION OF PREFERRED EMBODIMENTS

Figure 1:
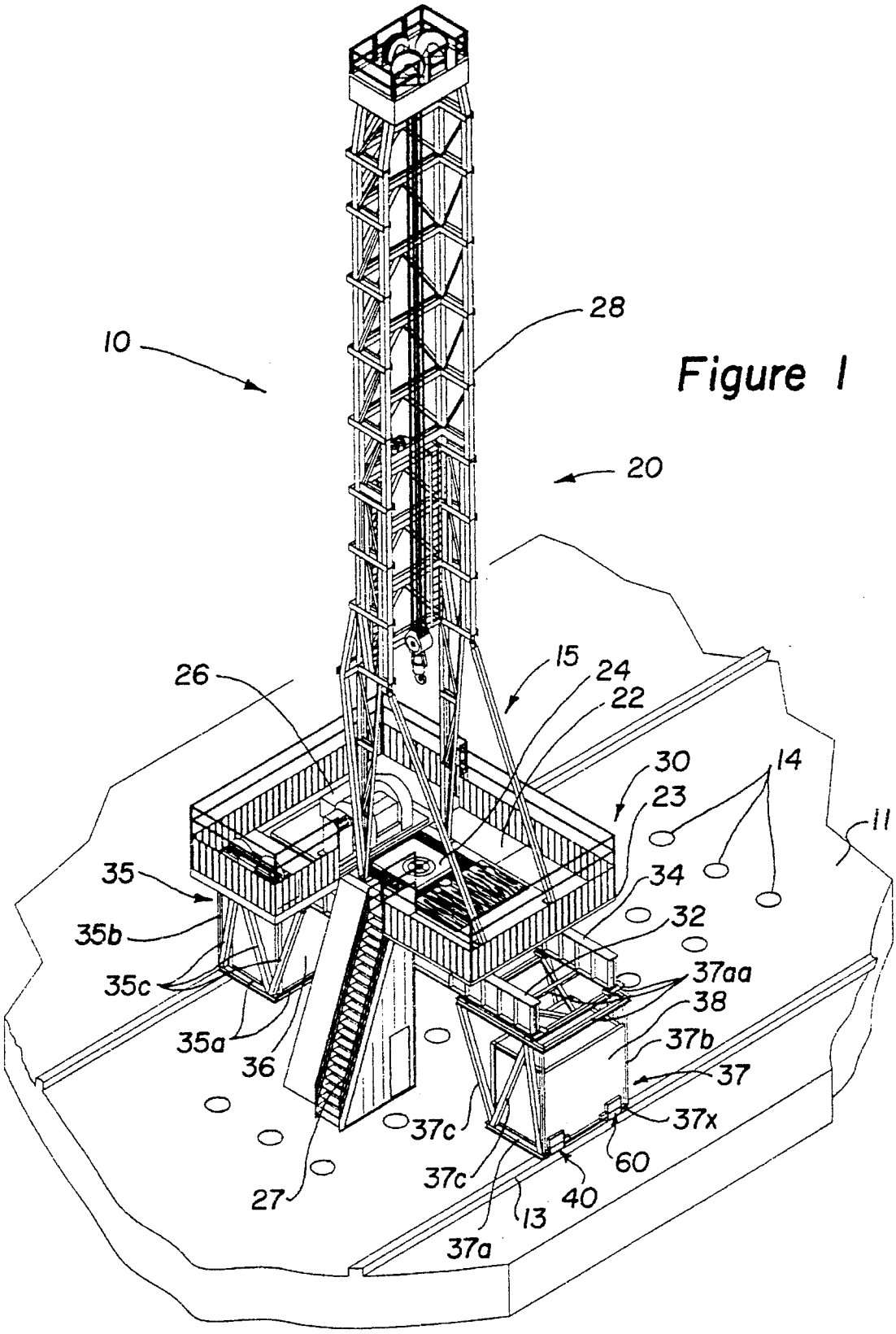
FIG. 1 is an isometric view of an oil rig with a movable upper structure on an offshore platform with one embodiment of the present inventions positioned adjacent the lower support structure of the rig.

The present inventions will be described by referring to apparatus and methods showing various examples of how the inventions can be made and used. In these drawings reference numerals are used through the several views to indicate like or corresponding parts.

Referring to FIG. 1, the numeral 10 generally designates an offshore platform assembly. The platform assembly 10 comprises a platform floor 11 which is provided with a plurality of holes 14 for drilling or working wells, first and second platform floor track beams 12 and 13, and a rig assembly 15 positioned on the platform floor 11 over discrete regions of holes 14 and movably disposed between track beams 12 and 13.

Rig assembly 15 includes an upper structure 20 and moveable base structure 30. Upper structure 20 comprises a rig platform 22, a mast 28 supported on the platform 22, engine and drawworks 26 for raising and lowering chains, pipes, and other drilling and workover equipment through holes 14, and a rotary table 24 for positioning over a hole 14 in platform floor 11 through which a well is to be drilled or worked. A ladder or stairway structure 27 is also provided. Base supporting structure 30 comprises a pair of strongback beams 32 and 34 which are supported on footings 35 and 37. Strongback beams 32 and 34 provide support for upper structure 20.

Rig assembly 15 rests upon platform track beams 12 and 13 which extend the full length of the platform 11 and comprise steel channels or I-beams. In the design of offshore platforms, these beams 12 and 13 have sufficient strength to support heavy equipment which must be mounted on the platform 11 during drilling, production, and workover of the wells.

As hereinafter more fully explained, moveable base structure 30 allows rig assembly 15 to be moved laterally along platform floor 11 and longitudinally of track beams 12 and 13 to permit rotary table 24 to be selectively moved over discrete regions of holes 14 in platform floor 11. Base structure 30 straddles track beams 12 and 13, and footings 35 and 37, which support strongback beams 32 and 34, are movably supported on track beams 12 and 13 for selectively moving rig assembly 15 along the longitudinal axes of track beams 12 and 13. Upper structure 20 comprising rig platform 22, rotary table 24, and mast 28, is secured to strongback beams 32 and 34 using clamps, such as C-type clamps.

As best seen in FIG. 1, each footing 35, 37 comprises a box frame structure which includes horizontal beam members 35*a*, 35*aa* and 37*a*, 37*aa*, vertical column members 35*b* and 37*b*, and bracing members 35*c* and 37*c*. Each footing 35, 37 defines an enclosure for storing containers or tanks 36 and 38, with the outer most edges 35*x* and 37*x* of footings 35, 37 resting on track beams 12 and 13. Clamps (not shown), such as C-clamps, secure footings 35, 37 to track beams 12 and 13 when rig 15 is to be maintained in a stationary position.

Tanks 36 and 38 constitute structural truss members and are enclosed box type structures which may be used for storing water or drilling mud.

Strongbacks 32 and 34 are preferably made of I-beams or other structural members, boxed in for increased web stiffness and overall load carrying capacity. Rig platform beam members 23 are sized to support mast 28, a tool house (not shown), engine and drawworks 26, and other drilling and working equipment. Beam members 23 rest on strongbacks 32, 34, extending longitudinally of strongbacks 32, 34, and are removably secured thereto by clamps (not shown), such as C-clamps.

Figure 2:
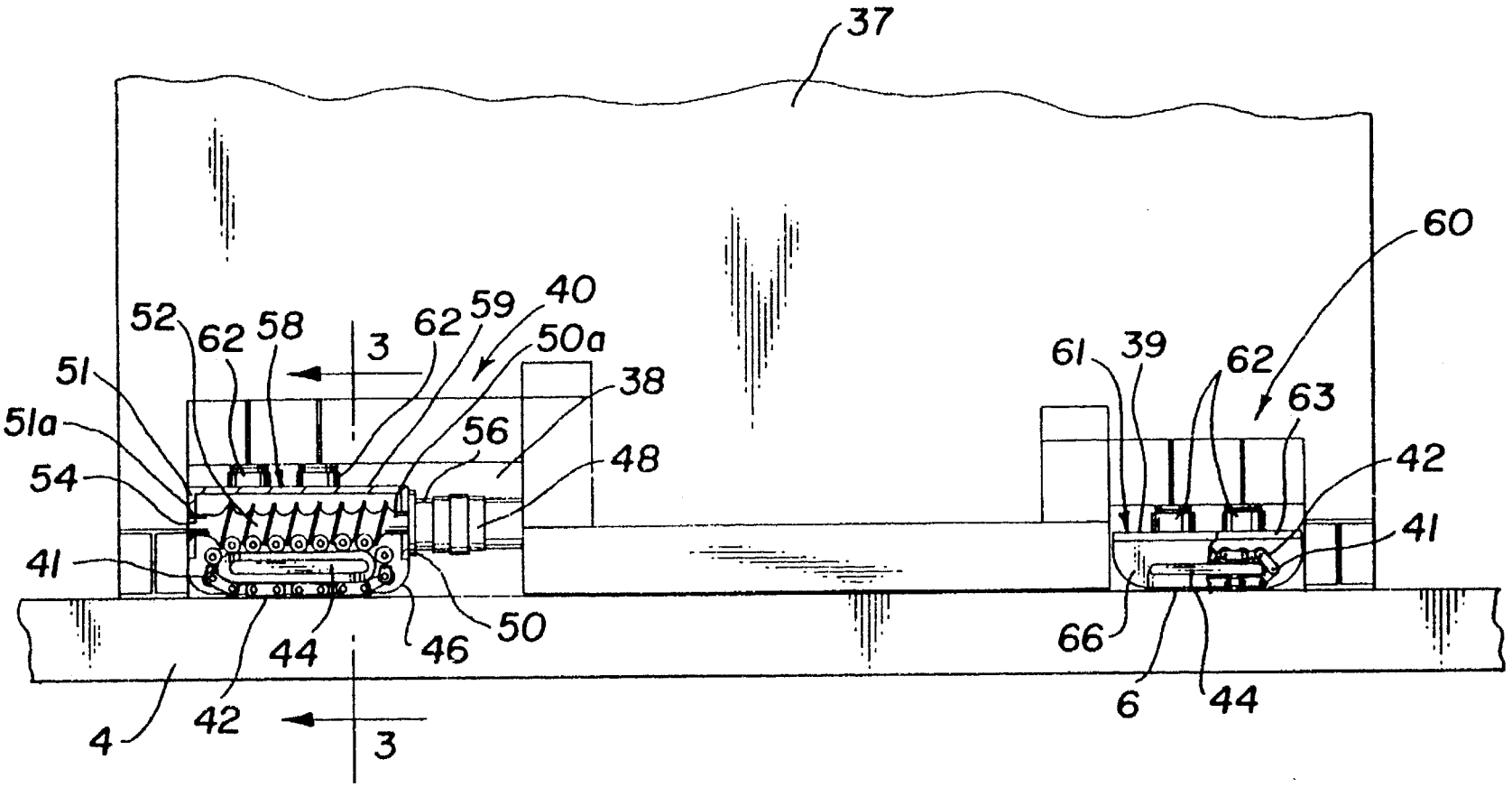
FIG. 2 is a side elevational view of the embodiment of the present inventions shown in FIG. 1.
Figure 3:
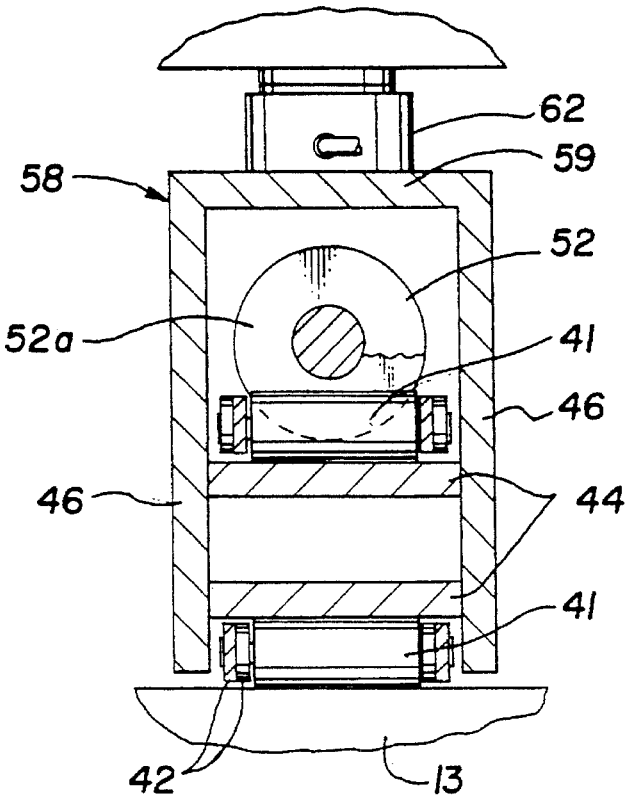
FIG. 3 is a sectional view taken on line 3—3 of FIG. 2, looking in the direction of the arrows.

As best illustrated in FIG. 2, retractable driver roller assemblies 40 are provided and captured in first recess portions 38 of footings 35 and 37, and idler roller assemblies 60 are captured in second recess portions of footings 35 and 37. (Only the driver roller assembly 40 and idler roller assembly 60 adjacent to tank 38 are shown in the drawings; however the driver roller assembly 40 and idler roller assembly 60 adjacent to tank 36 are identical to the driver roller assembly 40 and idler roller assembly 60 adjacent to tank 36 and are positioned in an identical manner with respect to tank 38). Footings 35 and 37 rest on platform beams 12 and 13 when retractable driver and idler roller assemblies 40 and 60 are in a retracted position. While in the retracted position, driver roller assemblies 40 and idler roller assemblies 60 engage platform floor beams 12 and 13 but are not load bearing until footings 35 and 37 are elevated from platform beams 12 and 13 thereby loading driver and idler roller assemblies.

Driver roller assemblies 40 each comprise a box frame enclosure 58 having a central core 44 defined therein, and a plurality of rollers 41 pivotally connected to endless link chains 42 positioned around the central core 44. Box frame 58 comprises an upper load bearing jacking plate 59, and a pair of downwardly extending side plate members 46 extending down from jacking plate 59 to maintain the endless link chains 42 in alignment with respect to central core members 44 such that the endless link chains 42 and rollers 41 revolve about central core members 44 when the rig is to be moved and to provide support for central core 44 which is fixably interposed between side members 46. In addition, side plate members 46 provide structural stiffness and load bearing capacity to box frame 58. The roller-core-chain assemblies shown are constructed from Hilman rollers.

Each driver roller assembly 40 also comprises a hydraulic motor 48, a worm gear 52, a reduction gear 56, and thrust bearings 54. Hydraulic motor 48 includes a drive shaft and is mounted to rearward plate member 50 of box frame 58. Worm gear 52 is supported by thrust bearings 54 which are positioned in aperture 51*a* of forward plate member 51. Worm gear 52 is coupled to hydraulic motor 48 through reduction gears 56 positioned in aperture 50*a* provided in rearward plate member 50 of box frame 58. Worm gear 52 transmits the rotary motion of the motor drive shaft to rollers 41 and endless link chain 42 of driver roller assembly 40 when the rig assembly 15 is to be moved. As motor 48 runs, the drive shaft spins causing worm gear 52 to rotate about the horizontal plane. The worm wheel rims 52*a* mesh with rollers 41 and push against the rollers as worm gear 52 rotates, causing the rollers to roll thereby moving rig assembly 15 in the desired direction.

Similarly, idler roller assemblies 60 comprise a box frame 61 having a central core 44 defined therein, a plurality of rollers 41 pivotally connected to endless link chains 42 positioned around the central core 44. Box frame 61 comprises an upper load bearing jacking plate 63, a pair of side plate members 66 extending down from jacking plate 63 to maintain the endless link chains 42 in alignment with respect to central core members 44 such that the chains 42 and rollers 41 revolve about central core members 44 when the rig is to be moved and to provide support for central core 44 which is fixably interposed between side plate members 46. In addition, side plate members 66 provide structural stiffness and load bearing capacity to box frame 61. These roller-core-chain assemblies are constructed from Hilman rollers.

Hydraulic jacks 62 are mounted on jacking plates 59 of driver roller assemblies 40 and on jacking plates 63 of idler roller assemblies 60. Upon actuation, jacks 62 are arranged to push up against the footings 35 and 37 and elevate the rig assembly 15 with respect to platform floor beams 12 and 13 when the rig assembly 15 is to be moved longitudinally along beams 12 and 13.

When the rig assembly 15 is to be moved laterally of the platform and longitudinally along beams 12 and 13 as shown in FIG. 1, the clamps holding the footings 35 and 37 to the platform floor beams 12 and 13 are removed and hydraulic jacks 62 are operated to elevate the rig assembly 15. Hydraulic motors 48 are then actuated to drive the endless link chains 42 connecting rollers 41 of driver roller assemblies 40 and to move rig 15 longitudinally along beams 12 and 13. When rig assembly 15 has been moved the desired distance, hydraulic jacks 62 are then deactivated to lower footings 35 and 37 back onto the beams 12 and 13, and beams 12 and 13 are again clamped to the footings 35 and 37.

Figure 4:
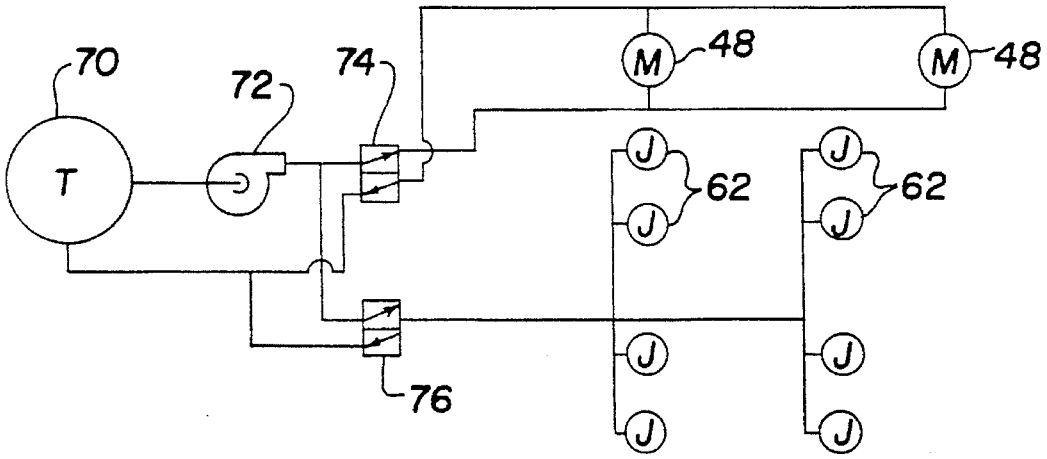
FIG. 4 is a schematic depiction of the control system used in the embodiment of the present inventions shown in FIG. 1.

The upper circuit shown in FIG. 4 is a schematic depiction of the circuit showing the tank 70, pump 72, and valve 74 for controlling hydraulic motors 48 and the lower circuit shown in FIG. 4 is a schematic depiction of the valve 76 of the circuit for controlling hydraulic jacks 62.

In an alternate embodiment, rig assembly 15 includes a moveable upper structure 20 and moveable base structure 30. Moveable upper structure 20 comprises a rig platform 22, a plurality of platform beam members 23 supporting the rig platform 22, a mast 28 supported on the platform 22, engine and drawworks 26 for raising and lowering chains, pipes, and other drilling and workover equipment through well holes 14, and a rotary table 24 for positioning over a hole 14 in platform 11 through which a well is to be drilled or worked. Base supporting structure 30 comprises a pair of strongback beams 32 and 34 which are supported on footings 35 and 37. Strongback beams 32 and 34 provide support for moveable upper structure 20.

As herein more fully explained, movable upper structure 20 moves longitudinally along strongbacks 32, 34 and laterally between platform track beams 12, 13, while movable base structure 30 moves longitudinally along platform track beams 12 and 13.

To move upper structure 20 relative to base structure 30, moveable upper structure 20 is provided with a plurality of retractable driver and roller assemblies 40, 60. Rig platform beam members 23 extending between strongbacks 32, 34 and are provided with a box-like enclosure (not shown) for capturing roller assemblies 40 and 60. When roller assemblies 40, 60 are retracted, rig platform beam members 23 rest on strongbacks 32, 34, and are removably secured thereto by clamps (not shown), such as C-clamps.

Hydraulic jacks 62 are positioned between roller assemblies 40, 60 and strongback beams 32, 34. When upper structure 20 is to be moved, the C-clamps are removed and hydraulic jacks 62 are activated to elevate platform beam members 23 from strongback beams 32, 34 and to extend roller assemblies into a load bearing position. Once in the load bearing position, driver roller assembly motor 48 is activated to drive rollers 41 so that rig upper structure 20 can be moved longitudinally relative to the strongbacks 32, 34 to reach a desired position. After the desired position had been reached, the rig platform 22 can be lowered back onto the strongbacks 32 and 34 and the clamps then reapplied to hold upper structure 20 in this position.

Base structure 30 comprises footings 35 and 37 which support strongbacks 32 and 34. Footings 35 and 37, which support strongback beams 32 and 34, are movably supported on track beams 12 and 13 for selectively moving rig assembly 15 along the longitudinal axes of track beams 12 and 13.

Each footing 35, 37 comprises a box frame structure which includes horizontal beam members **35*a*, 35*aa* and 37*a*, 37*aa*, vertical column members 35*b* and 37*b*, and bracing members 35*c* and 37*c*. Each footing 35, 37 defines an enclosure for storing containers or tanks 36 and 38, with the outer most edge 35*x* and 37*x* of footings 35, 37 resting on track beams 12 and 13. Clamps (not shown), such as C-clamps, secure footings 35, 37 to track beams 12 and 13 when rig assembly 15** is to be maintained in a stationary position.

Retractable driver roller assemblies 40 are provided and captured in first recess portions 38 of footings 35 and 37, and idler roller assemblies 60 are captured in second recess portions 39 of footings 35 and 37. (Only the driver roller assembly 40 and idler roller assembly 60 adjacent to tank 38 are shown in the drawings; however the driver roller assembly 40 and idler roller assembly 60 adjacent to tank 36 are identical to the driver roller assembly 40 and idler roller assembly 60 adjacent to tank 38 and are positioned in an identical manner with respect to tank 38). Footings 35 and 37 rest on platform beams 12 and 13 when retractable driver and idler roller assemblies 40, 60 are in the retracted position. While in the retracted position, driver roller assemblies 40 and idler roller assemblies 60 engage platform floor beams 12 and 13 but are not load bearing until footings 35 and 37 are elevated from platform beams 12 and 13 causing driver and idler roller assemblies to be load bearing rollers.

To move rig assembly 15 laterally of the platform and longitudinally along beams 12 and 13, as shown in FIG. 1, the clamps holding the footings 35 and 37 to the platform floor beams 12 and 13 are removed and hydraulic jacks 62 are operated to elevate the entire rig assembly 15 with respect to beams 12 and 13. Hydraulic motors 48 are then actuated to drive rollers 41 and endless chains 42 of driver roller assemblies 40 moving rig assembly 15 longitudinally along beams 12 and 13. When rig assembly 15 has been moved the desired distance, hydraulic jacks 62 are then deactivated to lower footings 35 and 37 back onto the beams 12 and 13, and beams 12 and 13 are again clamped to the footings 35 and 37.

This arrangement of providing a moveable upper structure 20 laterally of track beams 12 and 13 and a moveable base structure 30 longitudinally of track beams 12 and 13 allows rotary table 24 to be selectively moved over any hole 14 in platform 11.

In yet another embodiment of the present inventions, moveable base structure 30 and moveable upper structure 20 are provided with fixed position driver and idler roller assemblies 40, 60, eliminating the need for hydraulic jacks 62. However, load bearing plates 59 and 63 are still needed to support rig assembly 15 on driver and idler roller assemblies 40, 60. In addition, while still capturing roller assemblies 40, 60, first and second recesses 38, 39 are sized to only partially enclose the fixed position roller assemblies 40, 60 such that both roller assemblies 40 and 60 are continually load bearing. Fixed position driver assembly 40 and idler roller assembly 60 can be provided between lower structure 30 and platform floor beams 12 and 13 and between upper structure 20 and lower structure 30 as described in the previous embodiments.

The embodiments shown and described above are only exemplary. Many details neither shown nor described are often found in the art. It is not claimed that all of the details, parts, elements, or steps described and shown were invented herein. Even though numerous characteristics and advantages of the present inventions have been set forth in the foregoing description, together with details of the structure and function of the inventions, the disclosure is illustrative only, and changes may be made in the details, especially in matters of shape, size and arrangement of the parts, within the principles of the inventions to the full extent indicated by the broad general meaning of the terms used in the annexed claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

I claim:

1. An apparatus for moving a structure on surface comprising:

a load bearing roller assembly for supporting a structure, said roller assembly having a fixed central core;

a plurality of rollers connected together by an endless chain disposed about said central core;

a motor having a drive shaft and a means to selectively energize said motor; and a worm gear coupled to said motor shaft, said worm gear meshes with and engages the endless chain, to transmit the rotation of the drive shaft to the endless chain thereby causing the endless chain to rotate about said central core and thereby translating said structure across a surface.

2. An apparatus for moving a structure on a surface as defined by claim 1 wherein the motor comprises an electric motor.

3. An apparatus for moving a structure on a surface as defined by claim 1, wherein said motor comprises a hydraulic motor.

4. An apparatus for moving a structure on a surface comprising:

a load bearing roller assembly for supporting a structure, said roller assembly having a fixed central core and captured in a recess in said structure;

a plurality of rollers connected together by an endless chain disposed about said central core, said rollers having a retracted non-load bearing position in said recess and an extended load bearing position in said recess and said rollers providing support for said structure when in said extended position;

a means to selectively move said rollers from said non-load bearing position to said load bearing position and to move said rollers from said load bearing position to said non-load bearing position; and a driving means to move said endless chain about said central core thereby translating said structure across a surface.

5. An apparatus for moving a structure on a surface as defined by claim 4 wherein said driving means comprises:

a motor having a shaft and a means to selectively energize said motor; and a transmission means to transmit the rotation of the motor shaft to the endless chain thereby causing the endless chain to rotate about said central core and thereby translating said structure across a surface.

6. An apparatus for moving a structure on a surface as defined by claim 5 wherein said transmission means includes a worm gear coupled to said motor shaft, said worm gear meshes with and engages the endless chain.

7. An apparatus for moving a structure on a surface as defined by claim 4 wherein said means to selectively move said rollers from said non-load bearing position to said load bearing position and to move said rollers from said load bearing position to said non-load bearing position comprises an elevating means interposed between said roller assembly and said structure.

8. An apparatus for moving a structure on a surface as defined by claim 7 wherein said elevating means comprises a hydraulic jack.

9. A self-powered rig moving assembly comprising:

a load bearing enclosure for supporting a structure, said load bearing enclosure having a fixed central core, and said load bearing enclosure captured in a recess in said structure;

a roller assembly comprising a plurality of rollers connected together by an endless chain and disposed about said central core, said rollers having a retracted non-load bearing position in said recess and an extended load bearing position, and said roller assembly providing support for said structure when in said extended position;

a elevating means interposed between said enclosure and said structure to selectively move said roller assembly from said non-load bearing position to said load bearing position and to move said roller assembly from said load bearing position to said non-load bearing position;

a motor having a shaft and a means to selectively energize said motor; and a transmission means to transmit the rotation of the motor shaft to the endless chain thereby causing the endless chain to rotate about said central core and thereby translating said structure across a surface.

10. A self-powered rig moving assembly as defined by claim 9 wherein said transmission means includes a worm gear coupled to said motor shaft, said wormgear meshes with and engages the endless chain.

11. A self-powered rig moving assembly as defined by claim 9 wherein the motor comprises an electric motor.

12. A method for moving a structure on an offshore platform, comprising the steps of:

connecting a plurality of rollers together by an endless chain;

positioning the endless chain and rollers about a central core member;

supporting a structure on a central core; and driving the rollers by a motor including the step of transmitting the driving force of the motor by coupling a worm gear to the motor and positioning the worm gear to engage the rollers and the endless chain.

13. A method for moving a structure on a offshore platform, comprising the steps of:

connecting a plurality of rollers together by an endless chain;

positioning the endless chain and rollers about a central core;

capturing the rollers and central core in a load bearing enclosure and capturing the enclosure in a recess of a structure to be moved;

sizing said recess to fully enclose said rollers when rollers are non-load bearing and to partially enclose said rollers when rollers are load bearing;

selectively loading and unloading said rollers with the weight of the structure; and driving the rollers by a motor.

14. A method for moving a structure on an offshore platform as defined by claim 13 wherein the step of selectively loading and unloading said rollers comprises positioning an elevating means between the structure and the enclosure, raising the structure to load the rollers, and lowering the structure to unload the rollers.

15. A method as defined in claim 13, wherein said structure comprises an oil rig.

* * * * *